United States Patent [19]

Comparetto et al.

[11] 4,279,046

[45] Jul. 21, 1981

[54] FOLDAWAY BED CENTER

[76] Inventors: John E. Comparetto, 108 Cropper St., Chincoteague, Va. 23336; Richard A. Hamilton, Jr., 1561 Potomac Heights Dr., Oxon Hill, Md. 20022

[21] Appl. No.: 26,637

[22] Filed: Apr. 3, 1979

[51] Int. Cl.[3] ..... A47C 21/04

[52] U.S. Cl. ..... 5/503; 5/284; 5/414; 5/508; 312/237

[58] Field of Search ..... 5/2, 53 R, 414, 503, 5/284, 508, 512, 196; 312/237, 240

[56] References Cited

U.S. PATENT DOCUMENTS

| | | | |
|---|---|---|---|
| 3,089,150 | 5/1963 | Briggs et al. | 5/68 |
| 3,248,147 | 4/1966 | Testa | 5/496 |
| 3,514,794 | 6/1970 | Pofferi | 5/2 R |
| 3,596,297 | 8/1971 | Janies | 5/414 |
| 3,660,591 | 5/1972 | Schultz et al. | 5/2 R |
| 4,109,331 | 8/1978 | Champeau | 5/284 |

FOREIGN PATENT DOCUMENTS

| | | | |
|---|---|---|---|
| 2397809 | 7/1977 | France | 5/414 |

*Primary Examiner*—Casmir A. Nunberg
*Attorney, Agent, or Firm*—J. C. Wray

[57] ABSTRACT

An adjustable writing desk, storage and entertainment center apparatus attachable to the head of a bed to provide bedridden patients with easy access to writing materials, a writing surface and privacy in viewing television and listening to radio and recorded music by enclosing the patient's head and upper torso within the apparatus which is equipped with sound insulation.

19 Claims, 9 Drawing Figures

FIG. 1
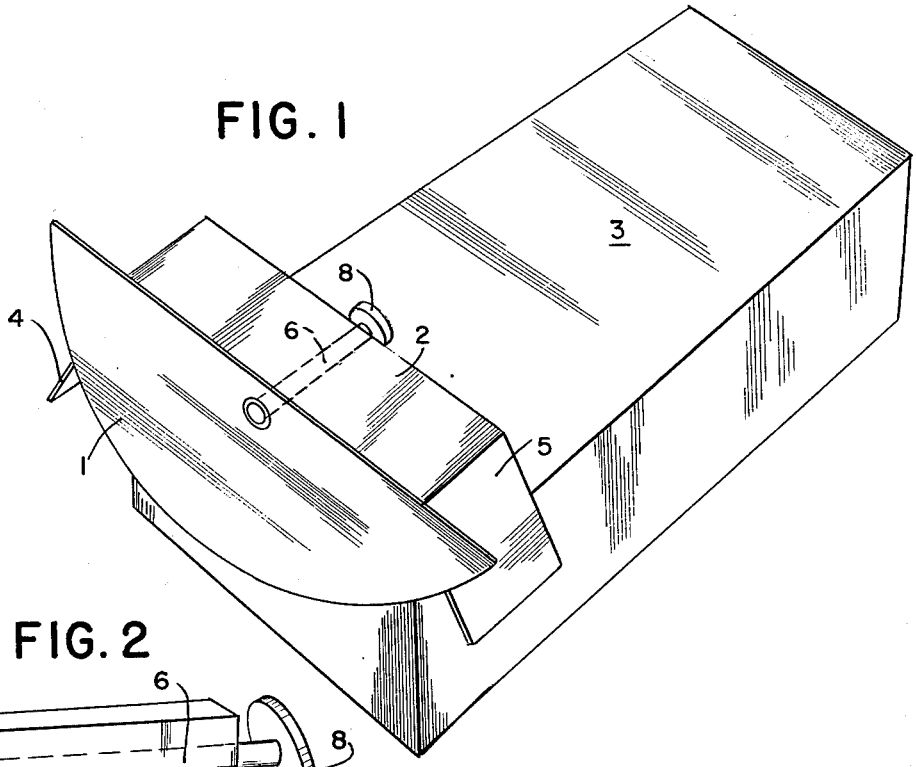
FIG. 2
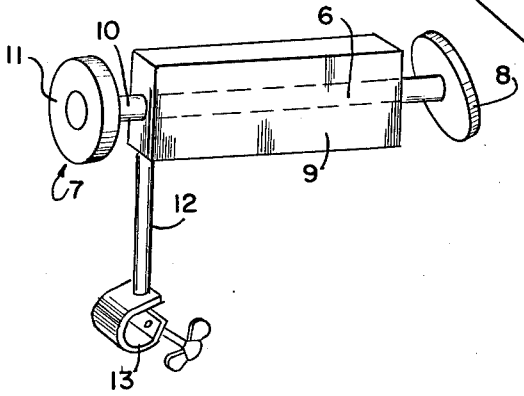
FIG. 3
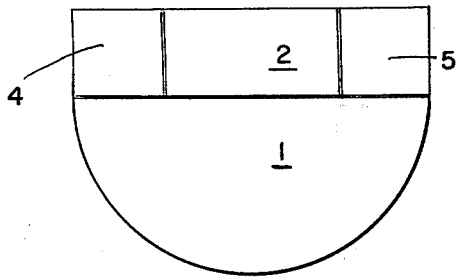
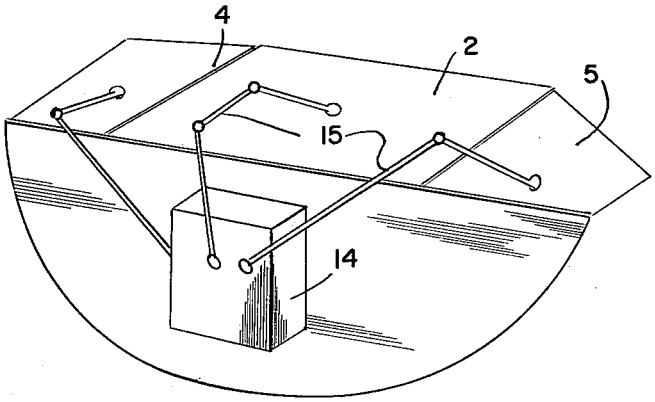
FIG. 5

FIG. 4
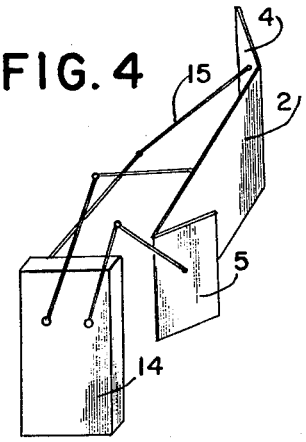
FIG. 8
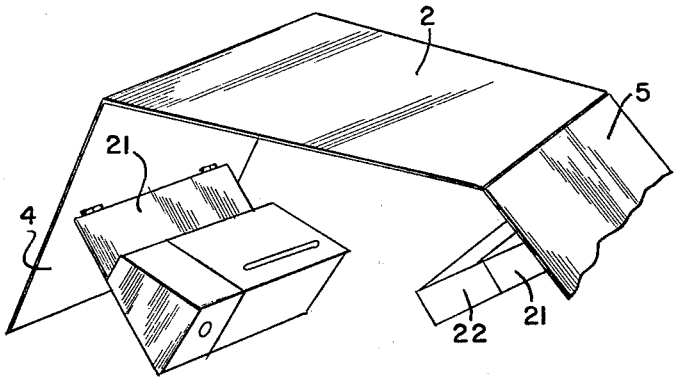
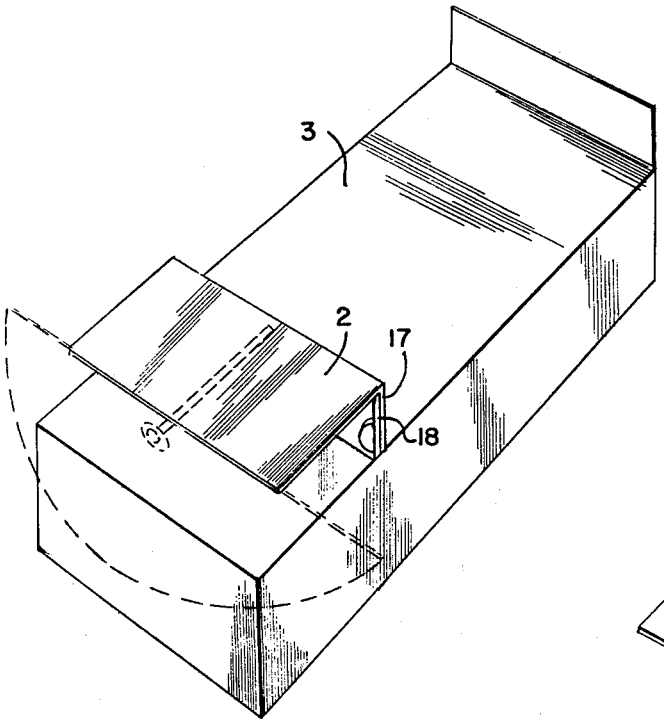
FIG. 7A
FIG. 7B
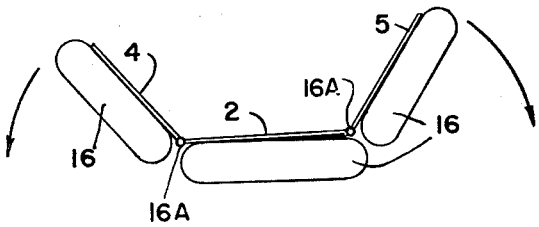
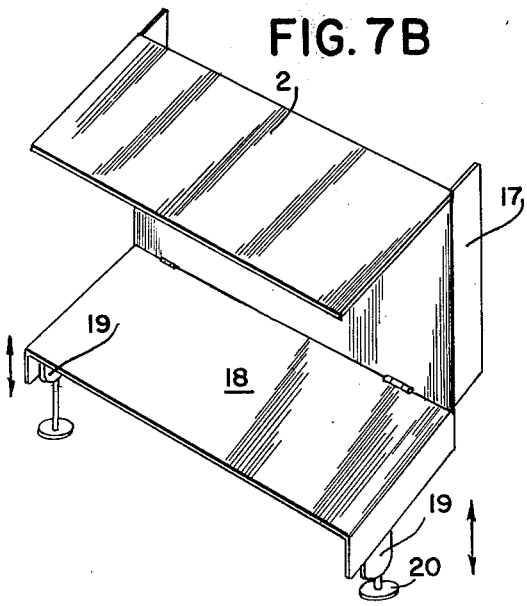

FOLDAWAY BED CENTER

BACKGROUND OF THE INVENTION

Patients with spinal injuries and other bedridden patients have been hindered in their ability to write letters in bed in either the supine or on the side positions due to the cumbersomeness of currently available writing platforms. Writing materials stored in bedside drawers are inaccessible to the patient. Additionally, television screens are often in awkward off-center positions and at such a distance that only hand-held speakers/channel selector devices provide appreciable sound delivery. But these devices produce poor fidelity. The present invention can place the TV screen dead center or near center and allow high fidelity speaker systems for each ear. Further, the patient is permitted by the present invention to write in bed, use a mirror or make-up table, and perform other routine tasks that would otherwise require assistance of others. Further advantages of the present invention over previous bedside storage and table arrangements will become more apparent as the invention is described.

SUMMARY OF THE INVENTION

Briefly, the present invention provides a new and improved system to allow a bedridden patient to have easy access to a steady writing platform or table, a storage place for pencils, pens, tissues, and mirror. Additionally, the present invention functions as an entertainment center for the bedridden patient including both stereo and television. Both the table, storage and entertainment center features are constructed so as to be available to the supine, the on-the-side patient, and patients that are able to sit up in bed.

The invention is designed to be easily deployed and easily stored. Further, the invention provides attaching means for oxygen hoses, permitting the tent-like structure of the invention to serve as an oxygen tent.

BRIEF DESCRIPTION OF THE DRAWINGS

FIG. 1 shows an oblique view of the apparatus at the head end of the bed.

FIG. 2 shows a rotational axle for pivoting the apparatus.

FIG. 3 shows the stored position with wings retracted.

FIG. 4 shows hydraulic deployment arms.

FIG. 5 shows another view of the panels and the deployment arms.

FIG. 6 shows another view of the panels and the accoustical insulation.

FIG. 7A shows deployment to position 1.

FIG. 7B shows deployment to position 2.

FIG. 8 shows the container and drawer sections deployed.

DETAILED DESCRIPTION OF THE INVENTION

The invention consists of a series of panels attached by hinging mechanisms or of a pliable material with the ability to be held in shape and changed back to the original shape. In its simplest form, the device consists of a rotatable backboard member 1 attached to a hinged section 2 parallel or near parallel to the bed surface 3. Section 4 and 5 are hinged wing units attached to Section 2.

For accoustical considerations, 1 could be shaped in a semi-circle. Part 6 is a rotational axis for member 1 and member 2. In FIG. 2, 6 articulates with dial 7 which in turn is contiguous with Section 1. The articulation facet is 11. At the other end of the axle 6, section bracket 8 attaches to member 2. Collar or tube 9 allows 6 to rotate within. Rigid member 12 is attached to tube 9 and this is affixed by means of clamp or series of clamps 13 to bed frame structure.

As illustrated in FIG. 2, member 1 rotates independently with dial 7 while member 2 rotates independently with articulation 11 by moving with axle 6 separated from dial 7 by gasket or lubricated washers 10.

This rotational ability would be required for on-the-side patient positions while semi-circular or circular shapes would allow easier accoustical sealing. FIG. 3 shows the stored position with panels 4, 2, 5 and 1 within the same plane and parallel to the wall. Wings 4 and 5 retracted and 2 elevated all within the same plane as 1. FIG. 3 again shows Section 4 and 5 retracted while member 2 is elevated and all of these are within the same plane as 1. The backboard consists of a large circle. It would not need to be rotatable and less hardware would be necessary.

In a simple form the wings 4 and 5 and panel 2 would be moved manually into position with wings 4 and 5 being affixed by velcro straps to bed sides or mattress, thus completing a four-walled seal (actually three walls 1, 4 and 5 and a ceiling 2). Deployment of 4 and 5 as walls has accoustical value while at the same time lending support to the ceiling member 2. Since 2 may be equipped with a TV, tape deck, clock, oxygen hook-up, etc. affixed into modular cutouts within 2 and possibly 4 and 5, the entire structure could become too heavy for easy manual manipulation. This weight problem can be solved in fully equipped models by means of passive hand-manipulated or active motor-driven hydraulics affixed to 2, 4 and 5. FIG. 4 shows hydraulic power pack 14 with arms 15 affixed to 2, 4 and 5. FIG. 5 shows the deployment of 2, 4 and 5 with power pack 14 affixed to semi-circle 1.

Panels 1, 2, 4 and 5 have modular cutouts to accommodate TV, radio, speakers, drawer space, telephone hook-ups, oxygen hook-ups, and electrical outlets. The invention brings the writing desk, storage and and entertainment center close to the patient and affords the patient privacy in using it. The exact location of the modular cutouts would be by patent preference, though they could be standardized for production purposes. FIG. 6 depicts members 4, 5 and 2 bent back on themselves to show an overextension of foam or other accoustical material such that when 4 and 5 are deployed in their normal position in the direction of the arrows they are sealed along the hinged seam. Modular cutouts would be made through the accoustical materials.

The writing board with tissue tray, etc., could also be used for hospital meals or breakfast-in-bed in the home situation. The best method would be to have the desk surface hinged from the central member 2 at the foot direction edge in two folds, one for simply uncovering the central entertainment panel 2 and the second to deploy to a desk or eating surface. In FIG. 7A we show deployment to position number 1. Section 17 and 18, FIGS. 7A and 7B are stored flat against the panel 2 and can be deployed in position 1 for just the added accoustical and private effect of adding a foot direction wall or into position 2 for a table desk with Section 18 deployed down to bed level on resting arms 19. Arms 19 should be adjustable with stand screw 20 for various patient heights while Section 18 can be kept basically parallel to bed surface 3 by moving in direction of double straight arrows of FIG. 7B.

Container sections for pens, pencils, writing paper, etc., swing down from wings 4 and 5 and are hinged centrally on the wings to accommodate for sideway tilting of the assembly for the "on the side" patients. Shelf 21 is the same width as or slightly larger than container Section 22 so that it accommodates same in folded position. Outside surface of Section 17 when folded back to Section 2 affords a writing surface for persons who cannot sit up. The use of Velcro fasteners would be most useful for tacking up these foldable units.

We claim:

1. A foldable writing desk, storage and entertainment center apparatus attachable to the head of a bed comprising a series of panels attached by hinging mechanisms characterized by a rotatable backboard member attached to a hinged section parallel or near parallel to the bed surface, a rotational axis means included between the rotatable backboard member and the hinged section, the rotational axis means comprising an axle which articulates with a dial which is contiguous with the rotated backboard member and in which at the end of the axle opposite the dial a section bracket attaches to the hinged section, wing units attached to the hinged section, means to clamp other mechanisms to the bed structure, means to tilt or rotate the asembly sideways, means to manually move the wings of the device into position, modulator cutouts in the panels of the apparatus for insertion of radio, speakers, drawer space, telephone hookups, oxygen hookups, and electrical outlets, acoustical material attached to the panels for sound insulation, container sections affixed to the panels, means to move the entire assembly to and from its closed or storage position.

2. The apparatus of claim 1 in which the rotatable backboard member is shaped in a semi-circle.

3. The apparatus of claim 1 in which the axle is contained within a collar or tube which allows the axle to rotate within the collar or tube.

4. The apparatus of claim 5 in which a rigid member is attached to the collar or tube and this rigid member is attachable by means of a clamp to the bedframe structure.

5. The apparatus of claim 1 in which the rotatable backboard member rotates independently of the dial while the hinged section parallel or near parallel to the bed surface rotates independently with articulation by an articulation facet by moving with the axle which is separated from the dial by gaskets or lubricated washers.

6. The apparatus of claim 1 in which the panels of the device are in the same plane and parallel to the wall at the foot of the bed when the device is in the closed or storage position.

7. The apparatus of claim 1 in which the backboard section is not rotatable and comprises a full circle rather than a semi-circle.

8. The apparatus of claim 1 in which the wings and hinged panel parallel or near parallel to the bed surface can be moved manually into the open position to form a four paneled structure around the patients upper torso, with the wing sections being affixed by velcro straps to the bedsides or mattress.

9. The apparatus of claim 1 in which the hinged section parallel or near parallel to the bed surface is equipped with a TV, tape deck, clock, oxygen hookup, etc., or some combination of such accessories.

10. The apparatus of claim 1 in which modular cutouts are provided for insertion of TV, radio, clock, oxygen hookup, etc., or any combination of such accessories.

11. The apparatus of claim 1 in which a passive hand manipulated means is provided to move the structure into operating position.

12. A writing desk, storage, and entertainment center apparatus attachable to the head of a bed comprising a sheet of pliable material with the ability to be altered to and hold a shape and be changed back to its original shape, means to clamp the mechanism to the bed structure, means to tilt or rotate the assembly sideways, means to manually move the device into position for use, modular cutouts in the pliable panel of the apparatus for insertion of radio, speakers, drawer space, telephone hookups, oxygen hookups, and electrical outlets, acoustical material attached to the pliable panel for sound insulation, storage container sections affixed to the pliable panel, and one or more hydraulic power packs affixed to the pliable panel to move the structure into the operating position.

13. The apparatus of claim 12 in which the pliable panel of the device is parallel to the wall at the foot of the bed when the device is in the closed or storage position.

14. The apparatus of claim 12 in which portions of pliable panel is equipped with a TV, tape deck, clock, oxygen hookup, etc., or some combination of such accessories.

15. The apparatus of claim 12 in which the pliable panel can be moved manually or hydraulically into the operating position to form a four paneled structure around the patient's upper torso, with the wing sections being affixed by velcro straps to the bedsides or mattress.

16. The apparatus of claim 12 in which modular cutouts are provided in the pliable panel for insertion of TV, radio, clock, oxygen hookup, etc., or any combination of such accessories.

17. The apparatus of claim 12 in which a passive hand manipulated means is provided to move the structure into operating position.

18. The apparatus of claim 1 further comprising overextensions of foam accoustical material adjacent the hinging mechanism to seal between hinged sections.

19. A foldable writing desk, storage and entertainment center apparatus attachable to the head of a bed comprising a series of panels attached by hinging mechanisms characterized by a rotatable backboard member attached to a hinged section parallel or near parallel to the bed surface and wing units attached to the hinged section, means to clamp other mechanisms to the bed structure, means to tilt or rotate the assembly sideways, means to manually move the wings of the device into position, modulator cutouts in the panels of the apparatus for insertion of radio, speakers, drawer space, telephone hookups, oxygen hookups, and electrical outlets, acoustical material attached to the panels for sound insulation, container sections affixed to the panels, means to move the entire assembly to and from its closed or storage position, the means including a hydraulic power pack affixed to the hinged section parallel or near to the bed surface and the wing sections and a power pack attached to the backboard member being used to move the structure into the operating position.

* * * * *